US006529580B1

(12) United States Patent
Steinlage et al.

(10) Patent No.: US 6,529,580 B1
(45) Date of Patent: Mar. 4, 2003

(54) EXPLOSION BONDED ANODE STEM OF AN X-RAY TUBE ASSEMBLY

(75) Inventors: Gregory A. Steinlage, Milwaukee, WI (US); Thomas C. Tiearney, Jr., Waukesha, WI (US)

(73) Assignee: GE Medical Systems Global Technology Co., LLC, Waukesha, WI (US)

( * ) Notice: Subject to any disclaimer, the term of this patent is extended or adjusted under 35 U.S.C. 154(b) by 0 days.

(21) Appl. No.: 09/681,880

(22) Filed: Jun. 20, 2001

(51) Int. Cl.[7] ..... H01J 35/10; H01J 35/24; H01J 35/26; H01J 35/28

(52) U.S. Cl. ..... 378/130; 378/121; 228/127

(58) Field of Search ..... 378/130, 143, 378/144, 119, 121; 445/28, 29; 228/193, 107, 126, 127, 128, 129, 130, 131, 132, 133, 134

(56) References Cited

U.S. PATENT DOCUMENTS 4,962,519 A * 10/1990 Upadhya ..... 378/125
5,498,186 A * 3/1996 Benz et al. ..... 445/28
5,498,187 A * 3/1996 Eggleston et al. ..... 445/28
5,547,410 A * 8/1996 Eggleston et al. ..... 445/28
5,577,093 A 11/1996 Benz et al.
5,655,000 A * 8/1997 Benz et al. ..... 378/144
5,699,401 A * 12/1997 Jackson et al. ..... 378/144
5,788,401 A * 8/1998 Drenth ..... 285/332.3
6,118,852 A 9/2000 Rogers et al.

OTHER PUBLICATIONS http://www.highenergymetals.com.

* cited by examiner

*Primary Examiner*—Drew A. Dunn
*Assistant Examiner*—Courtney Thomas
(74) *Attorney, Agent, or Firm*—Ziolkowski Patent Solutions Group; Michael A. Della Penna; Carl B. Horton

(57) ABSTRACT

An x-ray imaging apparatus having an anode stem assembly with explosion-bonded joints is provided. Explosion-bonding the components of an anode stem assembly to one another provides a hermetic seal with increased reliability as well as reducing the anode stem's susceptibility to thermal and/or mechanical induced fracture. By eliminating the need for brazing and/or welding material within the anode stem, the present invention also provides an anode stem with increased heat transfer capabilities. Further, providing explosion-bonded joints creates a simple joint microstructure absent any voids and temperature-induced phases not previously present in the anode stem materials.

21 Claims, 3 Drawing Sheets

EXPLOSION BONDED ANODE STEM OF AN X-RAY TUBE ASSEMBLY

BACKGROUND OF INVENTION

The present invention relates generally to x-ray imaging systems and, more particularly, to an explosion bonded anode stem of an x-ray tube assembly.

Generally, an x-ray system such as those used for medical imaging, include a cylindrical vacuum enclosure housing a pair of opposed electrodes. One of the electrodes includes a cathode assembly which is located opposite the other electrode having a rotating disc-shaped anode assembly therein. Voltage is applied across the cathode and anode assemblies thereby causing thermal electrons emitted by the cathode to be accelerated toward the anode at a high velocity. A small portion of the energy is converted to high energy electromagnetic radiation in the x-ray spectrum with the remainder of the energy being converted to heat. These x-rays are emitted from the cylindrical enclosure and directed toward a subject for examination. The x-rays pass through the subject and are then detected by a detector assembly for subsequent image reconstruction. Application of these known x-ray systems is well known and include medical diagnostic imaging as well as security applications.

As indicated previously, only a small portion of the energy input is converted to x-rays. An overwhelming amount of the energy input is converted to heat. Typically, temperatures within the anode assembly during operation can reach upwards of 2000° Celsius. As a result, the anode assembly and, more particularly, the bonding joints of the anode stem of the anode assembly must be resistive to thermally induced fracture as well as provide a reliable hermetic seal.

Generally, an anode stem comprises a cylindrical sleeve portion fabricated from a copper-based alloy and a pair of rings, each ring being welded or brazed to each end of the cylindrical sleeve. Typically, the rings are fabricated from a stainless steel alloy. For proper and compliant operation of an x-ray system, it is imperative that the bonding of the rings to the cylindrical sleeve are resistant to corrosion and mechanical failure. Failure of the bonds joining the sleeve and the rings jeopardizes not only proper operation of the x-ray system, but can also result in premature failure.

Commonly, brazing and/or welding is used to conjoin the rings to the sleeve. Brazing and/or welding has a number of drawbacks including increasing the inefficiency of the x-ray system. That is, brazing and/or welding requires the introduction of a third metal to the anode stem configuration. Introduction of the brazing and/or welding materials not only decreases the reliability of the hermetic seal and the resistance to mechanical and/or thermal fracture, but also introduces temperature-induced phases to the anode stem that were not previously present. Furthermore, brazing and/or welding material potentially lowers the heat transfer capabilities within the stem assembly.

Explosion-bonding or explosive cladding is well-known in the art and is a metal-working technique commonly used to join dissimilar metals into a high quality joint. Joints formed by explosion-bonding have high mechanical strength, are ultra-high vacuum tight, and can withstand drastic thermal differentiations. Explosion-bonding is a solid state process that creates an atomic bond between dissimilar metals by using the force generated by controlled detonations to accelerate one metal onto another. Explosion-bonding is also desirable because metals may be joined together without losing their pre-bonded characteristics.

Therefore, it would be desirable to design an anode stem with improved resistance to mechanical and/or thermally induced fracture and increased heat transfer capability. It would also be desirable to provide an anode stem with increased reliability of hermetic seals/and improved resistance to corrosion without introducing temperature-induced phases not previously present in the original anode stem components.

SUMMARY OF INVENTION

The present invention is directed to an apparatus providing explosion bonds between components of an anode stem assembly overcoming the aforementioned drawbacks. Explosion bonding the components of an anode stem assembly to one another provides a hermetic seal with increased reliability as well as providing improved mechanical strength in the anode stem joints. Furthermore, joining dissimilar metals of an anode stem assembly by implementing explosion bonding increases the heat transfer capability of the anode stem and further provides an anode stem with improved resistance to mechanical and/or thermally induced fracture. Additionally, providing an explosion bonded joint generates a simple joint micro-structure absent voids or temperature-induced phases not previously present in the anode stem materials. Also, explosion bonding the components of an anode stem assembly decreases scrap and x-ray tube loss in fabrication and yields an x-ray system with increased efficiency, longevity, and safety.

Therefore, in accordance with an aspect of the present invention, an anode stem for an x-ray tube assembly is provided. The stem includes a cylindrical sleeve having an outer surface and an inner surface wherein the sleeve further includes at least one sleeve end. A ring is also provided extending outwardly from the at least one sleeve end. The anode stem has an explosion-bonded joint connecting the ring to the at least one sleeve end.

In accordance with another aspect of the present invention, an x-ray system comprises a central enclosure including a cooling chamber housing an x-ray generator and a cooling pump configured to circulate a coolant through the x-ray system. The system further includes a cathode end positioned at one end of the central enclosure and an anode end positioned at another end of the central enclosure. The anode end has an anode stem having a cylindrical sleeve including a first and second end. A core is provided within the anode stem extending from the first end of the sleeve toward the second end of the sleeve. A threaded frustoconical bore is positioned within the core wherein the bore includes an orifice coplanar with an outer surface of the core. A first outer ring is provided and extends outwardly from the first end of the cylindrical sleeve and a second outer ring is provided extending outwardly from the second end of the cylindrical sleeve. The first outer ring is connected to the first end of the sleeve with an explosion-bonded joint and the second ring is connected to the second end of the sleeve also with an explosion-bonded joint.

In accordance with yet another aspect of the present invention, an anode stem for an x-ray tube assembly includes a cylindrical sleeve. The sleeve includes an outer surface, an inner surface, and at least one sleeve end. The anode stem further includes a ring extending outwardly from the at least one sleeve end. Also, the anode stem includes a means for joining the ring to the at least one sleeve end without an intermediary material.

Various other features, objects and advantages of the present invention will be made apparent from the following detailed description and the drawings.

BRIEF DESCRIPTION OF DRAWINGS

The drawings illustrate one preferred embodiment presently contemplated for carrying out the invention.

In the drawings.

DETAILED DESCRIPTION

Figure 1:
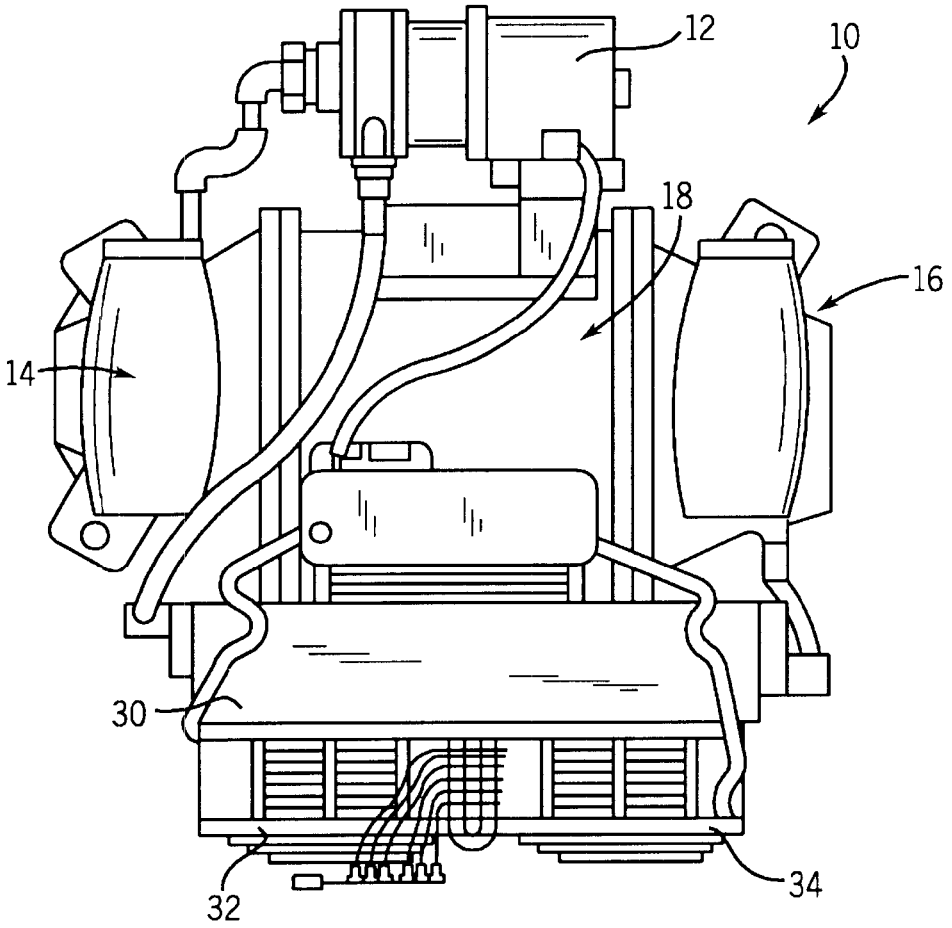
FIG. 1 is a plan view of a representative x-ray system.
Figure 2:
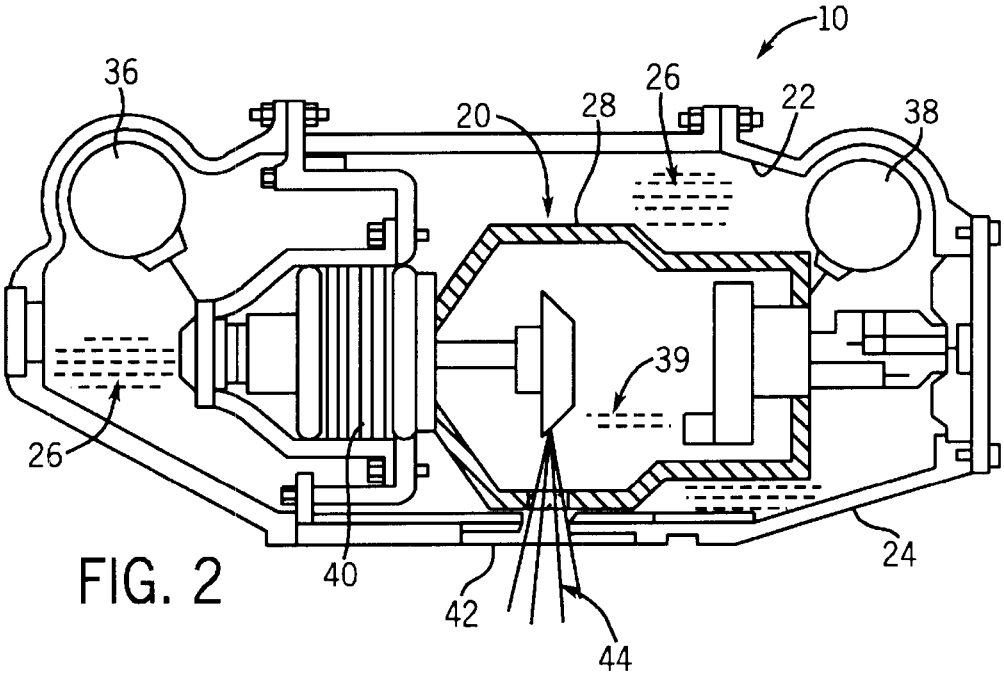
FIG. 2 is a sectional view of a portion of the x-ray system shown in FIG. 1.

Referring to FIGS. 1–2, an x-ray system 10 incorporating the present invention is shown. The x-ray system 10 includes an oil pump 12, an anode end 14, and a cathode end 16. A central enclosure 18 is provided and positioned between the anode end 14 and the cathode end 16. Housed within the central enclosure 18 is an x-ray generating device or x-ray tube 20 that will be discussed with particular reference to FIG. 3. A fluid chamber 22 is provided and housed within a lead lined casing 24. Fluid chamber 22 is typically filled with coolant 26 that will be used to dissipate heat within the x-ray generating device 20. Coolant 26 is typically a dielectric oil, but other coolants including air may be implemented. Oil pump 12 circulates the coolant through the x-ray system 10 to cool the x-ray generating device 20 and to insulate casing 24 from high electrical charges found within vacuum vessel 28. To cool the coolant to proper temperatures, a radiator 30 is provided and positioned at one side of the central enclosure 18. Additionally, fans 32, 34 may be mounted near the radiator 30 to provide cooling air flow over the radiator 30 as the dielectric oil circulates therethrough. Electrical connections are provided in anode receptacle 36 and cathode receptacle 38 that allow electrons 39 to flow through the x-ray system 10.

Casing 24 is typically formed of an aluminum-based material and lined with lead to prevent stray x-ray emissions. A stator 40 is also provided adjacent to vacuum vessel 28 and within the casing 24. A window 42 is provided that allows for x-ray emissions created within the system 10 to exit the system and be projected toward an object, such as, a medical patient for diagnostic imaging. Typically, window 42 is formed in casing 24. Casing 24 is designed such that most generated x-rays 44 are blocked from emission except through window 42.

Figure 3:
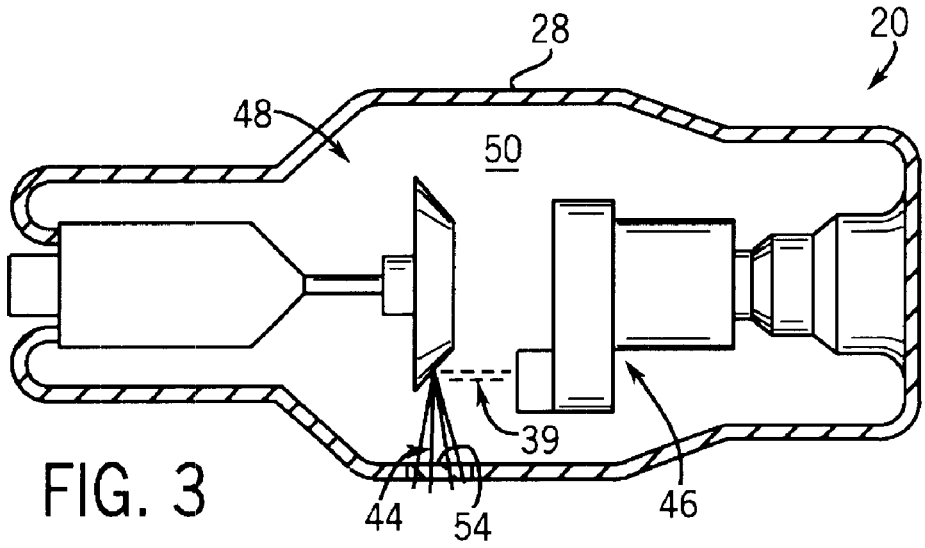
FIG. 3 is a cross-sectional side view of a portion of the x-ray system shown in FIG. 2.

Referring to FIG. 3, a typical x-ray-generating device 20 includes a cathode assembly 46 and a rotating, disc-shaped anode assembly 48. Typically, the anode assembly 48 is housed within a vacuum chamber 50 and vacuum vessel 28. Upon excitation of an electrical circuit connected to the cathode 46 and the anode 48, electrons 39 which are directed and accelerated towards the anode assembly 48 strike the surface of the anode 48 and thereby produce high frequency electromagnetic waves 44 in the x-ray spectrum. The x-rays are then directed out of the x-ray system 10 through a transmissive window 54 toward the object.

Typically, only a fraction of the energy input into the x-ray system is output as electromagnetic energy. The remainder of the energy is dissipated as heat. As indicated previously, a portion of the anode assembly temperature may exceed 2000° Celsius. As a result, the anode assembly and, in particular, the joints of the anode stem of the anode assembly must be designed to withstand these extremely high temperatures.

The present invention is directed to an apparatus for providing explosion bonded joints between components of an anode stem assembly. Explosion bonding the joints of the anode stem provides a vacuum seal with increased reliability, resistance to thermal and/or mechanical induced fracture, and increased heat transfer capability thereby increasing x-ray tube efficiency, longevity, and operability.

Figure 4:
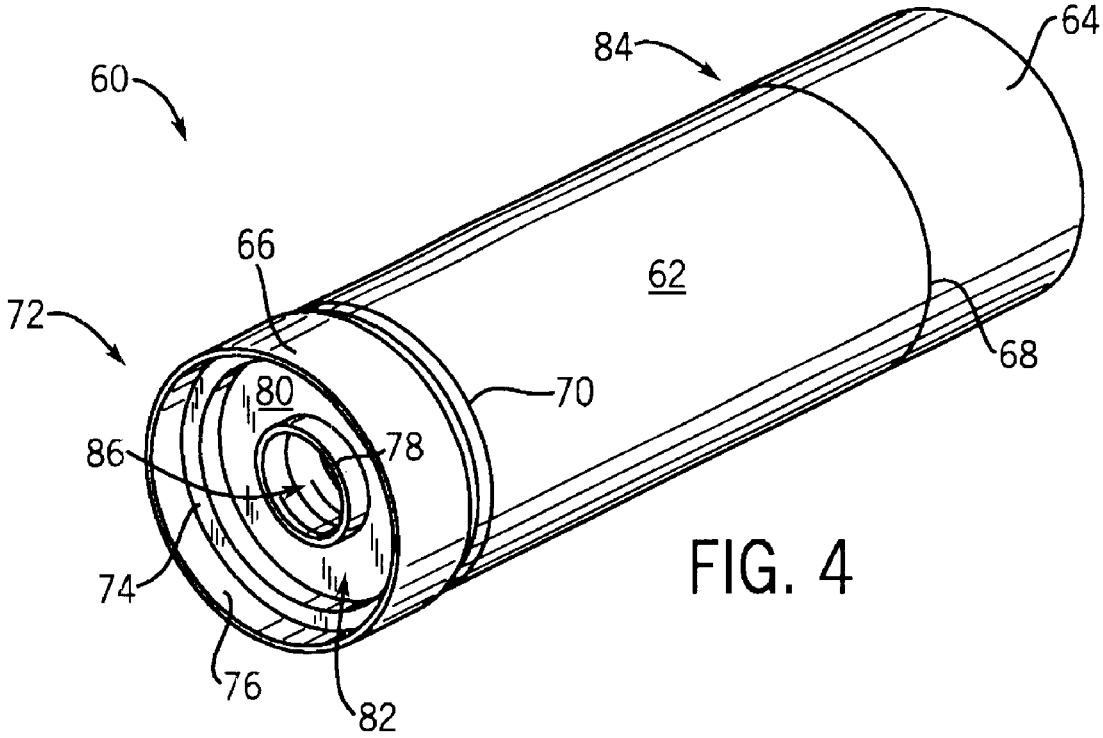
FIG. 4 is a perspective view of an anode stem of an x-ray tube in accordance with the present invention.
Figure 5:
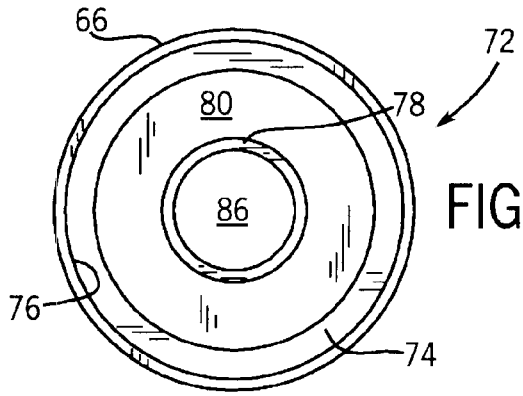
FIG. 5 is a left side plan view of the anode stem shown in FIG. 4.

Referring to FIGS. 4–5, an anode stem 60 of an anode assembly 48 in accordance with the present invention is shown. The stem 60 includes a cylindrical sleeve 62 and a pair of rings 64, 66 coupled to the sleeve 62. Typically, sleeve 62 is fabricated from a copper based alloy whereas the rings 64, 66 are commonly fabricated from a stainless steel alloy. Ring 64 is conjoined to the sleeve 62 by explosion bonding resulting in an explosion-bonded joint 68. Similarly, ring 66 is explosion bonded to the opposite end of sleeve 62 resulting in another explosion-bonded joint 70. At fore end 72 of the anode stem 60 an end cap 74 is provided along an interior surface wall 76 of ring 66. In a preferred embodiment, end cap 74 is formed by machining and/or milling following the explosion bonding of ring 66 and sleeve 62. Other techniques, such as, brazing or welding may also be implemented to form end cap 74. A bore cap 78 is positioned concentric to end cap 74 and extends outwardly from an orifice coplanar with the surface 80 of sleeve end 82. Preferably, bore cap 78 as well as end cap 74 are formed out of a stainless steel composite similar to the material used to form rings 64 and 66. Alternatively, an anode stem 60 may be formed with a beveled edge (not shown) instead of an end cap and without a bore cap.

As further shown in FIG. 4, the outer surface of sleeve 72 at aft end 84 is coplanar with the outer surface of ring 64. Defined by bore ring 78 and as will be discussed with reference to FIG. 6 is a frustoconical bore 86.

Figure 6:
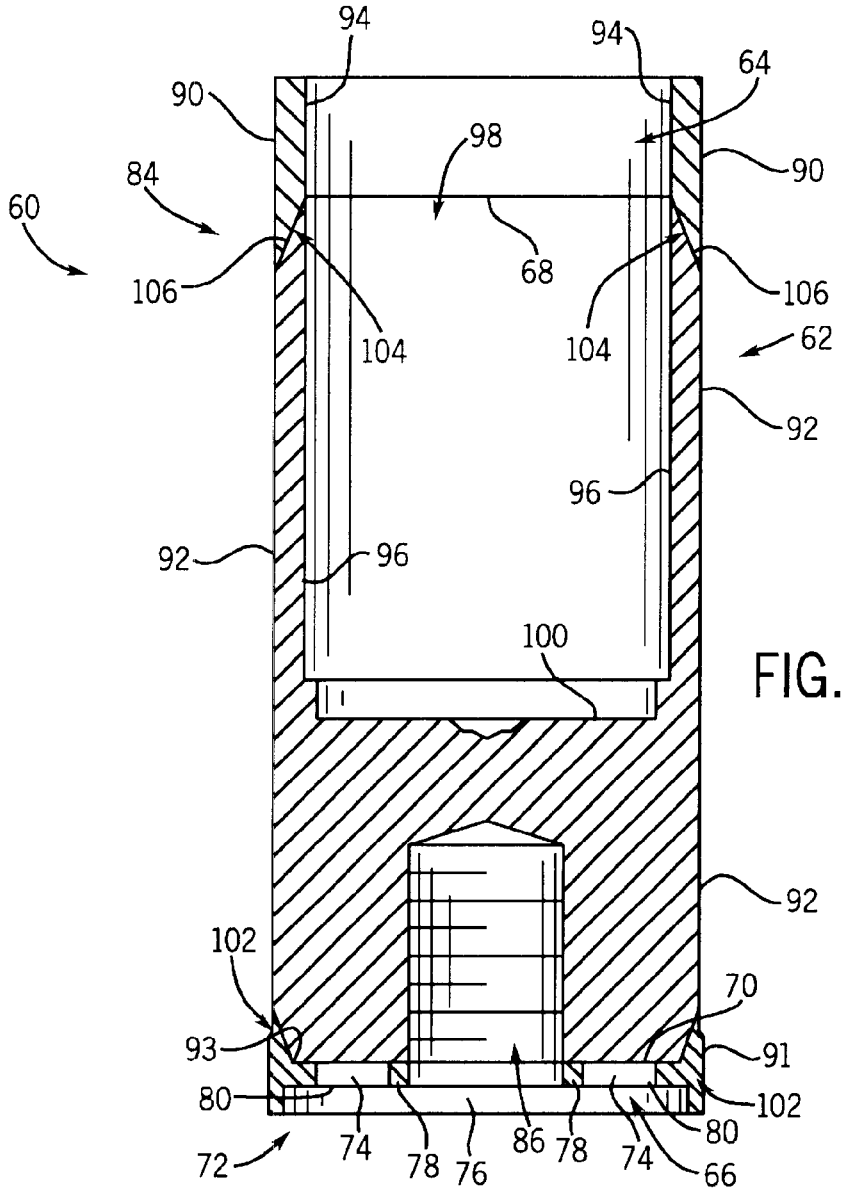
FIG. 6 is a cross-sectional view of the anode stem of FIG. 4.

Referring now to FIG. 6 and more particularly to the aft end 84 of anode stem 60, the outer surface 90 of ring 64 is coplanar with the outer surface 92 of sleeve 62. Further, inner surface 94 of ring 64 is also coplanar with the inner surface 96 of sleeve 62. End 84, in a preferred embodiment, is machined, i.e., milled such that inner sleeve surface 96 defines a cylindrical bore 98. Cylindrical bore 98 extends toward frustoconical bore 86 and terminates at wall 100. Referring to sleeve end 72, outer surface 91 of ring 66 has a circumference that is slightly greater than the circumference of sleeve outer surface 92. In another preferred embodiment, ring 66 has a circumference that is equal to and/or less than the circumference of sleeve outer surface 92.

In accordance with the present invention, rings 64 and 66 are explosion bonded to sleeve 62. Shown in FIG. 6 are overlapping joints 102 and 104. One of ordinary skill in the art will appreciate however, that other joint configurations, such as, butt-joints or serrated joints, may be used and are within the scope of this invention. Referring to joints 102 and 104, ring outer surfaces 90 and 91 extend laterally over sleeve outer surface 92. That is, ring inner surface 94 abuts sleeve surface 92 and inner surface 93 of ring 66 abuts sleeve surface 92. As shown, ring outer surfaces 90 and 91 are configured to be wider than ring inner surfaces 93 and 94. For increased mechanical strength, the present application also provides that joint surface 106 has a length greater than the thickness of ring 64 where the ring thickness is defined as the distance between ring outer surface 90 and ring inner surface 94.

Configuring the explosion-bonded joints in this overlapping manner provides a bond between sleeve 62 and the rings 64, 66 with increased hermetic reliability, mechanical strength, and resistance to fracture. Moreover, an anode stem incorporating an explosion-bonded joint in accordance with the present invention has improved resistance to corrosion, increased heat transfer, and the joints are absent any temperature induced phases not previously present in the copper based alloy sleeve 62 and the stainless steel alloy rings 64 and 66.

The present invention provides an x-ray imaging apparatus having an anode stem assembly with explosion-bonded joints. Explosion bonding of components of an anode stem assembly to one another provides a hermetic seal with increased reliability as well as reducing the anode stem's susceptibility to thermal and/or mechanical induced fracture. Further, explosion bonding eliminates the need for brazing and/or welding material within the anode stem, therefore, temperature induced failures not previously present in the anode stem material are not introduced. Additionally, an anode stem with explosion bonded joints creates a simple joint microstructure resulting in an anode stem with increased heat transfer capabilities.

Therefore, in one embodiment of the present invention, an anode stem for an x-ray tube assembly includes a cylindrical sleeve having an outer surface and an inner surface. The sleeve is configured such that a ring extends outwardly from a sleeve end. Further, an explosion bonded joint is provided to connect the ring to at least one sleeve end.

In a further embodiment of the present invention, an x-ray system includes a central enclosure having a cooling chamber housing an x-ray generator and a cooling pump configured to circulate a coolant through the x-ray system. The x-ray system further includes a cathode end positioned at one end of a central enclosure and an anode end positioned at another end of the central enclosure. The anode end is configured to include an anode stem having a cylindrical sleeve and a core extending from a first end of the sleeve toward a second end of the sleeve. A threaded frustoconical bore is positioned within the core such that an orifice of the bore is coplanar with an outer surface of the core. A first outer ring is provided and extends outwardly from the first end of the cylindrical sleeve and is connected to the sleeve by a first explosion-bonded joint. A second outer ring extends outwardly from the second end of the sleeve and is connected to the sleeve by a second explosion-bonded joint.

In accordance with yet another embodiment of the present invention, an anode stem for an x-ray tube assembly includes a cylindrical sleeve. The sleeve includes an outer surface, an inner surface, and at least one sleeve end. The anode stem further includes a ring extending outwardly from the at least one sleeve end. Also, the anode stem includes a means for joining the ring to the at least one sleeve end without an intermediary material.

The present invention has been described in terms of the preferred embodiment, and it is recognized that equivalents, alternatives, and modifications, aside from those expressly stated, are possible and within the scope of the appending claims.

What is claimed is:

1. An anode stem for an x-ray tube assembly comprising:

a cylindrical sleeve of an anode stem having an outer surface and an inner surface, the sleeve further including at least one sleeve end;

a ring extending outwardly from the at least one sleeve end; and a tapered joint joining the ring to form a one-piece bonded configuration for attachment to an x-ray tube.

2. An anode stem comprising:

a cylindrical sleeve having an outer surface and an inner surface, the sleeve further including at least one sleeve end;

a ring extending outwardly from the at least one sleeve end;

a tapered joint joining the ring to the at least one sleeve end; and wherein the tapered joint includes an explosion-bonded joint.

3. An anode stem comprising:

a cylindrical sleeve having an outer surface and an inner surface, the sleeve further including at least one sleeve end;

a ring extending outwardly from the at least one sleeve end;

a tapered joint joining the ring to the at least one sleeve end; and wherein the ring includes an interior surface and an exterior surface, wherein a width of the interior surface is configured more narrow than a width of the exterior surface.

4. An anode stem comprising:

a cylindrical sleeve having an outer surface and an inner surface, the sleeve further including at least one sleeve end;

a ring extending outwardly from the at least one sleeve end;

a tapered joint joining the ring to the at least one sleeve end; and wherein the sleeve inner surface extends laterally beyond the sleeve outer surface at the tapered joint.

5. The anode stem of claim 4 wherein the ring includes an interior surface and an exterior surface and is configured such that the exterior surface extends laterally beyond the interior surface.

6. An anode stem comprising:

a cylindrical sleeve having an outer surface and an inner surface, the sleeve further including at least one sleeve end;

a ring extending outwardly from the at least one sleeve end;

a tapered joint joining the ring to the at least one sleeve end; and wherein an exterior surface of the ring is tapered inwardly and the sleeve outer surface is tapered outwardly such that an exterior surface of the ring overlaps the sleeve outer surface at the tapered joint.

7. An anode stem comprising:

a cylindrical sleeve having an outer surface and an inner surface, the sleeve further including at least one sleeve end;

a ring extending outwardly from the at least one sleeve end;

a tapered joint joining the ring to the at least one sleeve end; and wherein the tapered joint forms a hermetic seal with increased resistance to at least one of mechanically and thermally induced fracture.

8. An anode stem comprising:

a cylindrical sleeve having an outer surface and an inner surface, the sleeve further including at least one sleeve end;

a ring extending outwardly from the at least one sleeve end;

a tapered joint joining the ring to the at least one sleeve end; and wherein the sleeve and the ring are formed of dissimilar metals.

9. An x-ray system comprising:

a central enclosure having a cooling chamber housing an x-ray generator therein;

a cathode end positioned at one end of the central enclosure; and an anode end positioned at another end of the central enclosure, the anode end including an anode stem having:

a cylindrical sleeve having a first and a second end;

a core extending from the first end of the sleeve toward the second end of the sleeve;

a frustoconical bore positioned within the core, the bore having an orifice coplanar with an outer surface of the core;

a first outer ring extending outwardly from the first end of the cylindrical sleeve, the first outer ring connected to the first end of sleeve by a first explosion bonded joint; and a second outer ring extending outwardly from the second end of the cylindrical sleeve, the second outer ring connected to the second end of the cylindrical sleeve by a second explosion bonded joint.

10. The x-ray system of claim 9 wherein the sleeve is comprised of a copper-based alloy and the rings are comprised of a stainless steel alloy.

11. The x-ray system of claim 10 wherein the explosion bonded joints are absent of temperature induced phases.

12. The x-ray system of claim 9 wherein a portion of the first ring overlaps at least a portion of the first end of the sleeve and a portion of the second ring overlaps at least a portion of the second end of the sleeve.

13. The x-ray system of claim 12 wherein an overlapping length resulting from the overlap of the portion of the second ring and the at least a portion of the second end of the sleeve is greater than sleeve thickness.

14. The x-ray system of claim 9 wherein an outer surface of the sleeve is coplanar with an outer surface of the second ring.

15. The x-ray system of a claim 9 further comprising a cooling pump configured to circulate a coolant through the x-ray system and a radiator configured to cool the coolant, the radiator positioned at a side of the central enclosure and wherein the coolant includes one of a dielectric oil and air.

16. An anode stem for an x-ray tube assembly comprising:

a cylindrical sleeve of an anode stem having an outer surface and an inner surface, the sleeve further including at least one sleeve end;

a ring extending outwardly from the at least one sleeve end; and a means for bonding the ring to the at least one sleeve end without an intermediary material, thereby forming a non-separable joint.

17. An anode stem comprising:

a cylindrical sleeve having an outer surface and an inner surface, the sleeve further including at least one sleeve end;

a ring extending outwardly from the at least one sleeve end;

a means for joining the ring to the at least one sleeve end without an intermediary material; and wherein the means for joining the ring to the at least one sleeve end includes a means for atomically bonding the at least one sleeve end and the ring.

18. An anode stem comprising:

a cylindrical sleeve having an outer surface and an inner surface, the sleeve further including at least one sleeve end;

a ring extending outwardly from the at least one sleeve end;

a means for joining the ring to the at least one sleeve end without an intermediary material; and wherein the means for joining the ring to the at least one sleeve end includes a means for bonding the at least one sleeve end and the ring without altering material properties of the at least one sleeve end and the ring.

19. An anode stem comprising:

a cylindrical sleeve having an outer surface and an inner surface, the sleeve further including at least one sleeve end;

a ring extending outwardly from the at least one sleeve end;

a means for joining the ring to the at least one sleeve end without an intermediary material; and wherein the means for joining the ring to the at least one sleeve end includes a means for bonding the at least one sleeve end and the ring without either one of brazing and welding.

20. The anode stem of claim 19 wherein the means for joining the ring to the at least one sleeve includes a means for bonding the at least one sleeve end and the ring with at least one of:

an increased heat transfer;

a hermetic seal with increased reliability;

an improved mechanical strength;

an improved resistance to fracture; and an improved resistance to corrosion.

21. An anode stem comprising:

a cylindrical sleeve having an outer surface and an inner surface, the sleeve further including at least one sleeve end;

a ring extending outwardly from the at least one sleeve end;

a means for joining the ring to the at least one sleeve end without an intermediary material; and wherein the at least one sleeve end is formed of a metal dissimilar to a metal forming the ring.

* * * * *